US005239937A

United States Patent [19]

Nino

[11] Patent Number: 5,239,937

[45] Date of Patent: Aug. 31, 1993

[54] ATTACHMENT FOR SEWING MACHINES

[76] Inventor: Kumao Nino, No. 21-3, 2-chome, Higashi Kamata, Ohta-ku, Tokyo, Japan

[21] Appl. No.: 883,117

[22] Filed: May 14, 1992

[51] Int. Cl.[5] ..... D05B 35/08

[52] U.S. Cl. ..... 112/135; 112/320; 112/235

[58] Field of Search ..... 112/135, 132, 134, 303, 112/311, 320, 235

[56] References Cited

U.S. PATENT DOCUMENTS

| | | | |
|---|---|---|---|
| 2,964,000 | 12/1960 | Rakacs | 112/135 |
| 2,983,239 | 5/1961 | Enos | 112/135 |
| 3,016,850 | 1/1962 | Caldwell | 112/135 |
| 4,073,249 | 2/1977 | Mulkey et al. . | |

FOREIGN PATENT DOCUMENTS 2-40376 3/1990 Japan .

*Primary Examiner*—Clifford D. Crowder
*Assistant Examiner*—Paul C. Lewis
*Attorney, Agent, or Firm*—Wenderoth, Lind & Ponack

[57] ABSTRACT

An attachment for a sewing machine includes a lever which is provided with a hole to receive a screw of a needle-bar and is rotatably supported by a lever stand arranged to be shifted upward and downward upon operation of the needle-bar. The lever stand pivotably supports a ratchet wheel and a connector plate at the upper end thereof and has a forked holder at another end thereof. A guide plate is provided with a feed plate therebeneath and is pivotably fastened to the connector plate and shiftably arranged on one side of the lever stand. A ratchet gear feed plate is provided with a ratchet pawl which is engagable with a tooth of the ratchet wheel to be rotated in a predetermined direction. The guide plate is further provided with a projection at one end thereof, the projection being engagable with a pin positioned on one side of the lever stand to stop further shifting of the guide plate.

4 Claims, 6 Drawing Sheets

ATTACHMENT FOR SEWING MACHINES

BACKGROUND OF THE INVENTION

This invention relates to attachments for sewing machines for forming ruffles in fabrics. There are many kinds of sewing machine attachments which enable ruffling of fabrics. However, these conventional types of attachments have some drawbacks which will hereinafter be explained.

A lever mounted shiftably on an attachment body is lifted upward and downward by means of a needle-bar of a sewing machine to which the end of the lever is removably fastened. With the upward and downward shifting of the lever, a ratchet wheel mounted on the end of the attachment body together with a connector stand is rotated in a predetermined direction by means of a ratchet of a ratchet gear feed plate mounted on the lever. As the ratchet wheel is thus rotated, the connector stand or plate having at its lower end a guide plate provided with a feed plate is shifted horizontally forward and backward, whereby the feed plate under which is disposed a fabric is shifted forward and backward while pressingly contacting the surface of the fabric with the result that a successive formation of ruffles on the fabric is obtained.

Generally speaking, the upward and downward strokes of a needle-bar of a sewing machine may be arranged differently according to the type of sewing machine to be used, while a ruffler attachment provided with a guide plate and a feed plate is designed to undergo forward and backward shifting by a fixed or predetermined distance. Therefore it is usual that a ruffler attachment having a feed plate which undergoes a particular predetermined shifting is to be chosen to be used with a particular sewing machine provided with a needle-bar which functions to shift upward corresponding with the particular predetermined shifting distance of the ruffler. In FIG. 6, reference character P indicates a needle piercing position of the fabric 48 and P′ shows a folded end of the fabric 48. Whenever the upward shifting distance of the needle-bar 41 provided with a needle 41*a* is performed to correspond with the predetermined shifting distance of a feed plate, normal even stitches 49 are formed in the fabric 48. However, when the upward shifting distance of the needle-bar 41 is longer than the predetermined shifting distance of the feed plate, an end P″ of folded fabric is formed away from the needle piercing position P as shown in FIG. 6 and irregular loop stitches 50 are formed, as shown in FIG. 7(A).

SUMMARY OF THE INVENTION

In view of the deficiencies of the conventional attachments, it is an object of the invention to provide a new and improved ruffler attachment for sewing machines to form uniform ruffling of fabrics regardless of the type of sewing machine to be utilized. More particularly, the object of this invention is to provide a means for adjusting needle-bar strokes of a sewing machine so that a ruffler attached to the sewing machine will provide uniform ruffling of the fabric.

With these and other objects in mind, the instant invention contemplates an attachment for forming uniform ruffles in fabrics. An apparatus, according to the present invention, contemplates an attachment for a sewing machine having a lever pivotably supported by a lever stand for pivotal movement upon vertical shifting of a needle-bar of the sewing machine, a lever stand which pivotably supports a ratchet wheel and a connector plate at the upper end thereof and has a forked holder at the end thereof, a guide plate provided with a feed plate therebeneath and which is pivotably fastened to the connector plate and shiftably arranged on one side of the lever stand, and a ratchet gear feed plate provided with a ratchet pawl. An adjusting means is provided for adjusting the distance of the upward pivoting motion of the lever in conjunction with the upward motion of the needle-bar to thereby adjust the horizontal shifting distance of the guide plate.

DETAILED DESCRIPTION OF THE INVENTION

Figure 1:
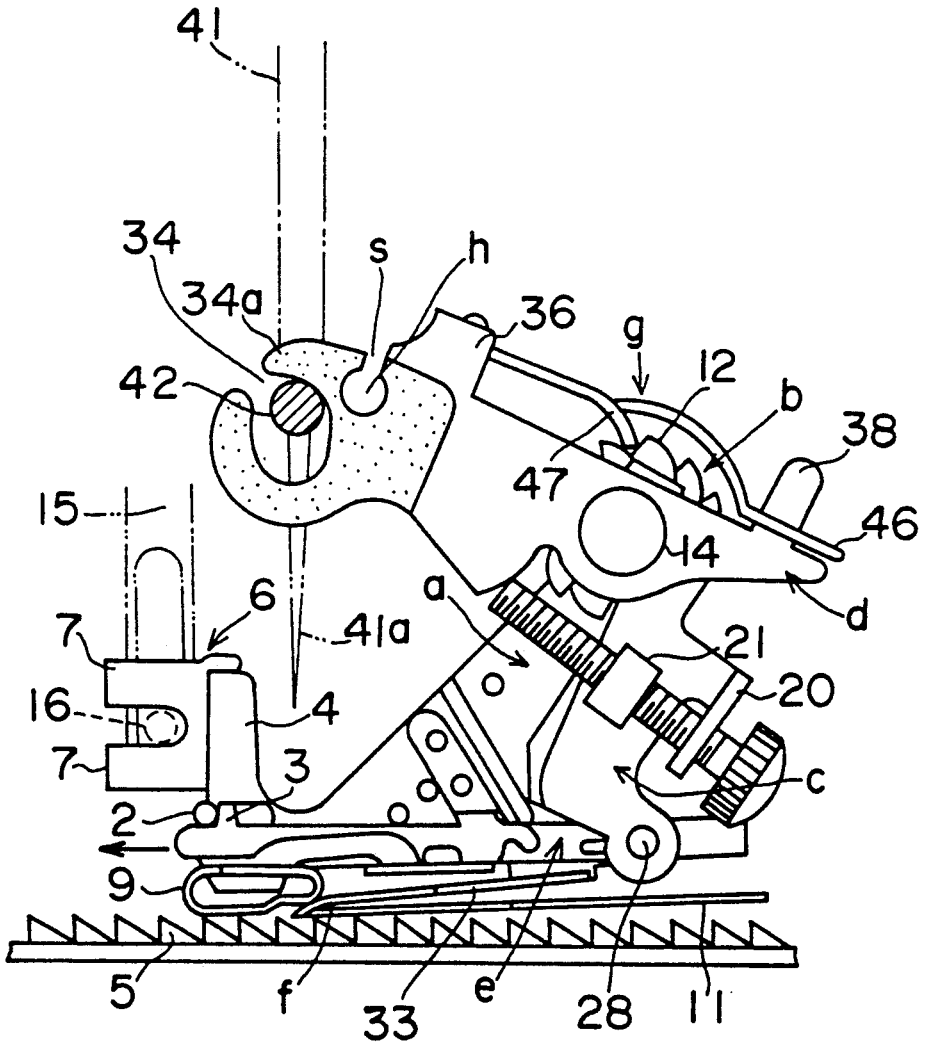
FIG. 1 is a side elevation view of an attachment according to the invention.
Figure 2:
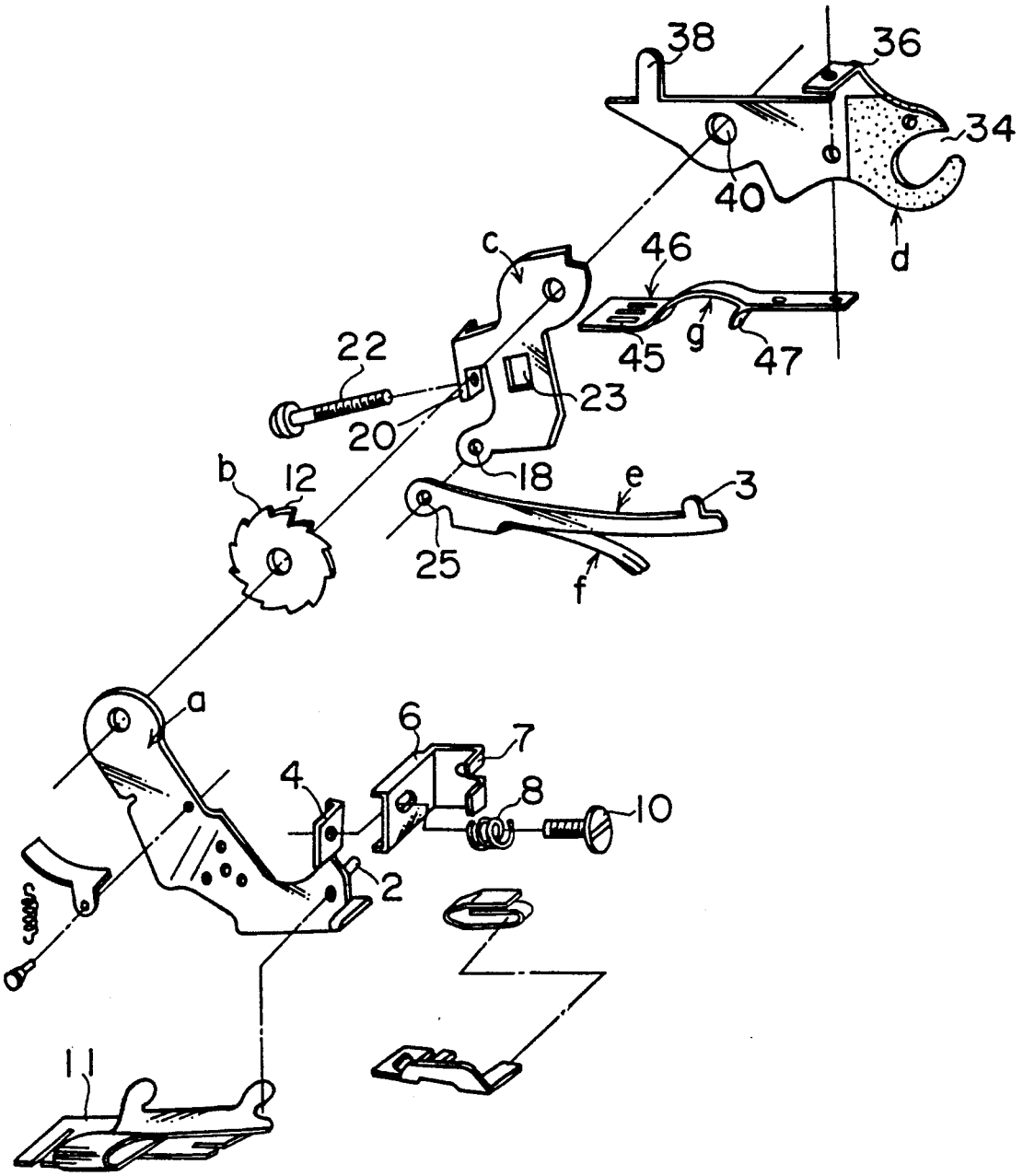
FIG. 2 is an exploded perspective view of the attachment shown in FIG. 1, including a conventional guide plate.
Figure 3A:
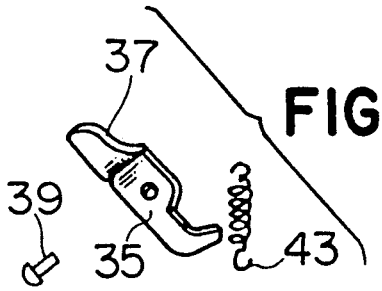
FIG. 3(A) is a perspective side view of a lever element of this invention
Figure 3B:
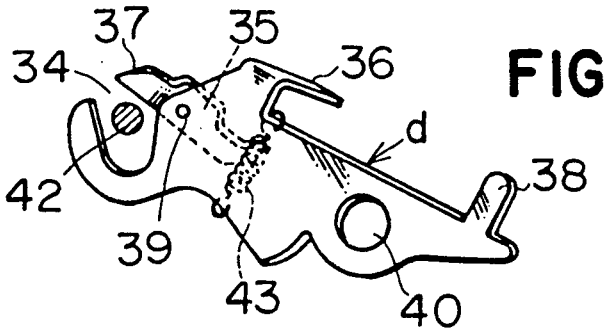
FIG. 3(B) is a perspective side view of a lever of this invention with the lever element fastened thereon.

Referring to FIGS. 1–3, inclusive, detailed descriptions of preferred embodiments of this invention will be explained. Referring to FIG. 1, an attachment of this invention is provided with a lever stand (a), a ratchet wheel (b), a conventional connector plate (c), a lever means (d), a conventional guide plate (e), a feed plate (f) and a ratchet gear feed plate (g).

The lever stand (a) is provided with a vertical wall 4 at the end thereof to which a holder 6 having a forked portion 7 is slidably fastened by means of a coil spring 8 and a screw 10. A fabric guide plate 11 is also fastened to one side of the lever stand (a). The connector plate (c) is pivotably fastened to the end of the guide plate (e) by means of holes 18 and 25 and a screw extending therethrough, as shown in FIG. 2. A screw 22 extends through a holder plate 20 to be held by a collar 21 fitted in a hole 23. The upper portion of the guide plate (e) has a projection 3 disposed at the end thereof. A ratchet wheel (b) having teeth 12 therearound is rotatably arranged between the lever stand (a) and the connector plate (c) by means of a pin 14 which in turn rotatably fastens the lever (d) to the connector plate (c) through a hole 40.

The lever (d) is provided with an opening 34 defined in one end and with a pin 38 protruding from the other end. Numeral 36 is a holder plate for the ratchet gear feed plate (g). A portion of the lever (d) around the opening 34 is preferably formed of synthetic materials such as plastics. The ratchet gear feed plate (g) having a ratchet pawl 47 projecting from the undersurface thereof may be assembled with the lever (d) by the insertion of projection 38 of the lever (d) into one of the slits 46 of an engagement plate 45 of the ratchet gear plate (g) and fastening the other end of the ratchet gear feed plate (g) to the holder plate 36 of the lever (d). The feed plate (f) is fitted to a feed plate holder 33 positioned underneath the guide plate (e). Numeral 9 is a fabric presser. The lever (d) is fastened to the needle-bar 41, having a needle 41*a* mounted at the end thereof, by means of a screw 42 positioned in the opening 34. To an attachment bar 15 arranged vertically and in parallel with the needle-bar 41, the lever stand holder 6 is fastened via a screw 16 positioned between the forked portion 7 of the holder 6 which is attached to the lever stand (a), as was heretofore explained. When the lever (d) is shifted up and down in unison with the up and down motion of the needle-bar 41, the ratchet 47 of the ratchet gear feed plate (g) pushes one of the teeth 12 of the ratchet gear (b) forward, whereby the connector plate (c) is shifted forward and backward with the result that the guide plate (e) is also shifted forward and backward, respectively, together with the feed plate holder 33 to which the feed plate (f) is fitted. The feed plate (f) is pressed against the fabric to produce ruffles in the fabric which is fed forward by a feed dog 5 arranged therebeneath.

The forward shifting distance of the feed plate (f) usually depends on the up and down distance of the lever (d). It usually happens that the shifting distance of the needle-bar 41 is differently arranged according to the type of sewing machine. Therefore, various sizes of ruffler attachment must be prepared in order to meet the shifting difference of the needle-bar of various machines.

According to a further aspect of this invention, the lever stand (a) is provided with a pin 2 protruding from one side thereof. The pin 2 may collide with the projection 3 arranged on the guide plate (e) when the guide plate (e) is shifted forward as shown by an arrow, in FIG. 1. This structure may help to stop any further forward shifting of the guide plate (e) and eventually to prevent an abnormal shifting of the feed plate (f) contacting the fabric to form normal ruffles.

Another aspect of this invention is illustrated in FIG. 1. A hole (h) having a slit (s) is defined in the portion of the lever d above the opening 34. An abnormal upward shifting movement of the needle-bar 41 is adjusted by the warping of the hole (h) such that the forward shifting of the feed plate (f) is limited to a normal distance through the lever (d) and the lever stand (c), whereby the formation of normal ruffles may be obtained.

Figure 4:
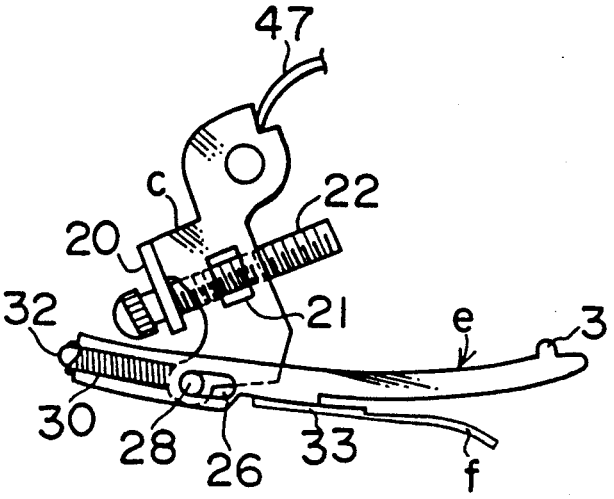
FIG. 4 is a side elevation view of a connector stand assembled with a guide plate, according to this invention.
Figure 5:
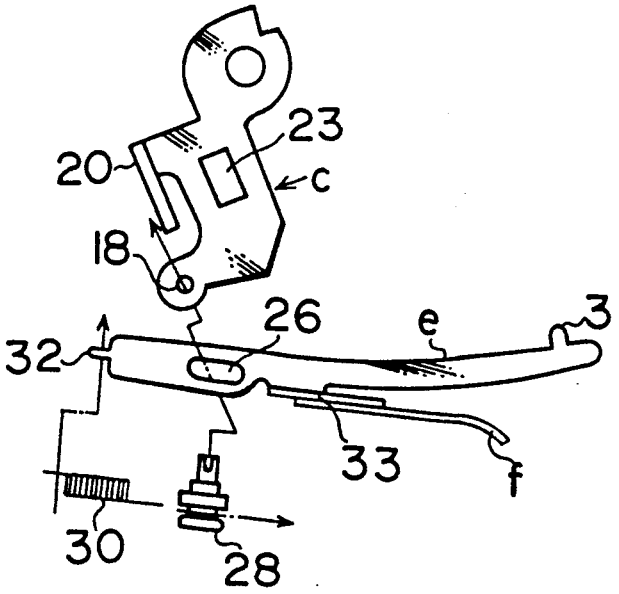
FIG. 5 is an exploded side elevation view of the connector stand and guide plate of FIG. 4.
Figure 6:
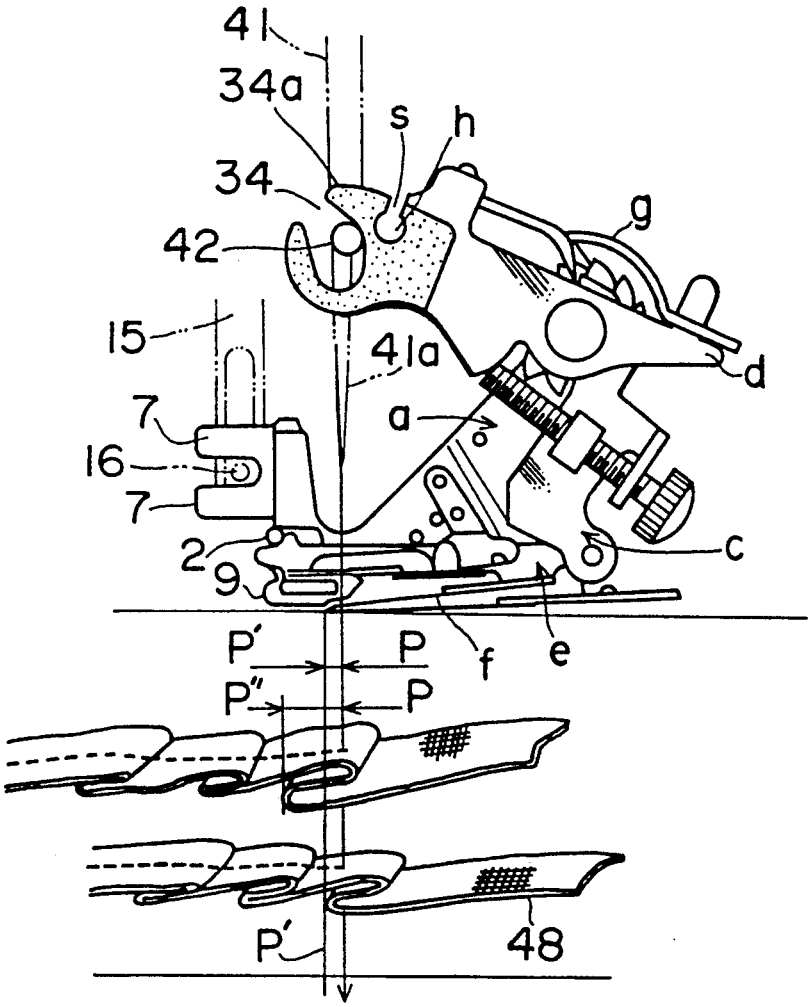
FIG. 6 is a side elevation view of the attachment including two types of stitches formed in fabrics created by different needle-bar strokes.
Figure 7A:
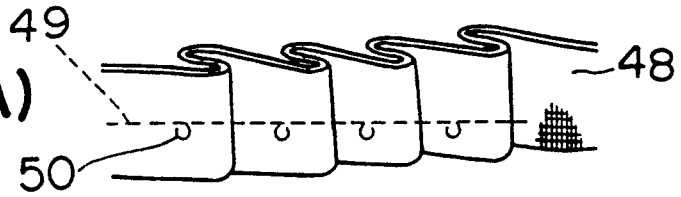
FIG. 7(A) is a perspective side view of a fabric showing abnormal stitch formation.
Figure 7B:
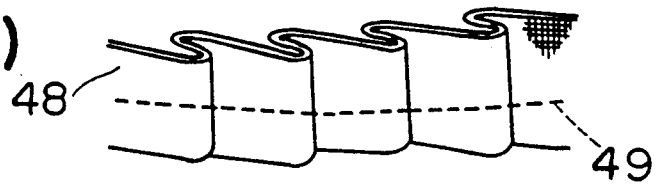
FIG. 7(B) is a perspective side view of a fabric showing normal stitch formation.

A further embodiment of this invention is shown in FIGS. 4 and 5. The guide plate (e) is provided with an elongate hole 26. The connector plate (c) is pivotably assembled with the guide plate (e) by means of a screw 28 inserted through the hole 18 of the connector plate (c) and the elongate hole 26. A coil spring 30 extends between the screw 28 and a projection 32 disposed at the end of the guide plate (e). Whenever the lever (d) is shifted upward beyond normal shifting of the guide plate (e), the screw 28 assisted by the biasing force of the coil spring 30 is shifted toward the projection 3 of the guide plate (e) through the elongate hole 26 when the projection 3 of the guide plate (e) collides with the pin 2 disposed on one side of the lever stand (a), whereby an abnormal over-shifting of the guide plate (e) is prevented.

One more embodiment of the present invention is illustrated in FIG. 3. An upper portion 34*a* of the opening 34 of the lever (d) is replaced by a pivotable lever 35 which is fastened to the lever (d) by means of a pin 39. A lever head 37 arranged at one end of the pivotable lever 35 protrudes outwardly to form the upper portion of the opening 34 while the other end of the pivotable lever 35 is mounted on the lever (d) by means of a coil spring 43 spanning the body of the lever. When the needle-bar 41 shifts upward beyond the normal distance, the needle-bar screw 42 contacts the undersurface of the head 37 of the pivotable lever 35 to lift the head 37 upward against the bias of the coil spring 43 to prevent further lifting of the lever (d) such that the abnormal shifting of the guide plate (e) and the feed plate (f) is prevented to avoid any undesirable formation of ruffles in the fabric by the feed plate (f).

What is claimed is:

1. An attachment for a sewing machine having a vertically shiftable needle-bar provided with a screw for attaching a needle thereto, said attachment comprising:

a lever stand having an upper end and a second end;

a ratchet wheel having a plurality of teeth and being mounted to said upper end of said lever stand;

a forked holder mounted to said second end of said lever stand;

a lever pivotably mounted to said upper end of said lever stand and having a receiving opening adapted to receive the screw of the needle-bar such that said lever is pivoted upon vertical shifting of the needle-bar;

a connector plate pivotably mounted to said upper end of said lever stand;

a guide plate pivotably mounted at a first end thereof to said connector plate such that said guide plate is shiftably arranged on one side of said lever stand, said guide plate having a projection at a second end thereof;

a feed plate mounted beneath said guide plate;

a ratchet gear feed plate mounted to said lever, said ratchet gear feed plate having a ratchet pawl provided therebeneath for engagement with said teeth of said ratchet wheel; and a pin connected to said second end of said lever stand and extending from one side of said lever stand at said second end thereof, for engaging with said projection of said guide plate to limit shifting of said guide plate.

2. An attachment as recited in claim 1, wherein an upper portion of said lever has a hole formed therein and a slit extending from said hole.

3. An attachment as recited in claim 1, wherein said guide plate has an elongate hole formed therein, and a screw is attached to said connector plate and extends through said elongate hole to pivotably mount said guide plate to said connector plate;

said guide plate has a protrusion formed at said second end thereof; and a coil spring extends between said protrusion and said screw attached to said connector plate.

4. An attachment as recited in claim 1, wherein said lever comprises a main lever body and a lever element pivotably mounted to said main lever body at a position defining an upper periphery of said receiving opening.

* * * * *

UNITED STATES PATENT AND TRADEMARK OFFICE

CERTIFICATE OF CORRECTION

PATENT NO. : 5,239,937
DATED : August 31, 1993
INVENTOR(S) : Kumao Niino

It is certified that error appears in the above-indentified patent and that said Letters Patent is hereby corrected as shown below:

On the title page inventor should read

--(76) Inventor: Kumao Niino--.

Signed and Sealed this

Thirty-first Day of May, 1994

Bruce Lehman

*Attest:*

BRUCE LEHMAN

*Attesting Officer*

*Commissioner of Patents and Trademarks*